US006932529B2

(12) United States Patent
Richtsmeier et al.

(10) Patent No.: US 6,932,529 B2
(45) Date of Patent: Aug. 23, 2005

(54) METHOD AND SYSTEMS FOR ACCESSING A SEPARATION PAD IN A PRINTING DEVICE

(75) Inventors: Dean Richtsmeier, Boise, ID (US); Harold M. Miller, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 119 days.

(21) Appl. No.: 10/218,276

(22) Filed: Aug. 13, 2002

(65) Prior Publication Data

US 2004/0033100 A1 Feb. 19, 2004

(51) Int. Cl.[7] ..... B41J 11/58

(52) U.S. Cl. ..... 400/624; 400/628; 271/104; 271/113; 271/121

(58) Field of Search ..... 400/624, 625, 400/626, 627, 628, 629; 271/104, 113, 121, 162

(56) References Cited

U.S. PATENT DOCUMENTS

| | | | | | |
|---|---|---|---|---|---|
| 5,372,359 | A | * | 12/1994 | Miura et al. | 271/119 |
| 5,443,251 | A | * | 8/1995 | Kan et al. | 271/16 |
| 5,570,876 | A | * | 11/1996 | Samii | 271/119 |
| 5,624,197 | A | * | 4/1997 | Morikawa et al. | 400/629 |
| 5,895,143 | A | | 4/1999 | Kawahara et al. | |
| 5,951,003 | A | | 9/1999 | Nojima et al. | |
| 6,055,407 | A | * | 4/2000 | Inoue et al. | 399/381 |
| 6,088,556 | A | | 7/2000 | Nagasaki et al. | |
| 6,298,778 | B1 | | 10/2001 | Onodera et al. | |
| 6,371,477 | B1 | * | 4/2002 | Lin | 271/121 |
| 6,485,014 | B1 | * | 11/2002 | Lin | 271/121 |
| 6,709,177 | B1 | * | 3/2004 | Sugimura | 400/605 |

* cited by examiner

*Primary Examiner*—Andrew H. Hirshfield
*Assistant Examiner*—Dave A. Ghatt

(57) ABSTRACT

A printing device including a feed roller assembly, a separation pad located adjacent to the feed roller assembly, and a printer housing having an access plate. The separation pad is user-accessible when the access plate is opened.

16 Claims, 11 Drawing Sheets

METHOD AND SYSTEMS FOR ACCESSING A SEPARATION PAD IN A PRINTING DEVICE

FIELD OF THE INVENTION

This invention relates to the field of printing devices. More particularly, this invention relates to methods and systems for replacing separation pads used in printing devices.

BACKGROUND OF THE INVENTION

Printing devices such as inkjet printers, laser printers, copiers, and facsimile machines often house stacks of paper or other media used in the printing process. The stacks of paper are usually in one or more trays that are incorporated into the printing device. Printing devices often have an automatic feeding mechanism to pull sheets of print media from the tray into the printing apparatus, where text, graphics, or other images may be printed on the sheets.

Sometimes, the automatic feeding mechanism may pull multiple sheets from the supply of print medium at one time. This often jams the printing device or causes other problems. To prevent the introduction of multiple pages into the transport path of the printing device at the same time, most printing devices include a separation pad. Separation pads are usually a small flap of rubber located adjacent to a main feed roller. As the name suggests, a separation pad is intended to separate sheets of print media as they enter the transport path of a printing device. Separation pads are generally biased toward the main feed roller and, over time, they become worn or contaminated and require replacement.

When a worn or contaminated separation pad is not replaced in a timely manner, multiple sheets are more likely to be feed into the printing device by the feeding mechanism. As noted, introducing multiple pages into a printing system usually result in jams. Simultaneously feeding multiple sheets can also cause poor printing quality and, sometimes, damage to printing system components. Therefore, the correct operation of separation pads is often important to the printing process.

While separation pads often work properly for the printing of many hundreds or even thousands of pages, when they do wear out or become contaminated, they are presently very difficult to replace. The difficulty with replacing separation pads on existing printing devices is so extreme that most manufacturers suggest that the ordinary user not attempt to make a replacement. Rather, most manufacturers suggest that ordinary users take their printing devices to an authorized printing system service dealer for separation pad replacements. In fact, in most vertical feed printing devices the replacement of a separation pad requires the almost complete disassembly of the printing device. In printing devices with a C-type paper path, the separation pad must be removed from a very narrow slot where the print media enters the printing device, which also usually requires some disassembly. Disassembly of current printing devices to replace the separation pad requires the use of tools and/or special equipment that many ordinary users do not have.

Because current printing systems require at least some disassembly of the printing device, attempts to replace separation pads often results in damage to the main feed roller assembly or other printer components, especially when an ordinary consumer or other person relatively unfamiliar with printing device attempts the replacement. However, taking a printing device to an authorized service dealer is usually quite inconvenient for the user because of the time spent without the printing device. In addition, it is often expensive to ask an authorized service representative to make the replacement.

There are some printing devices that use an opposing roller instead of a separation pad. However, such rollers are relatively uncommon in low cost printing devices, i.e., under $500.

SUMMARY OF THE INVENTION

The present invention provides a printing apparatus including a feed roller assembly, a separation pad located adjacent to the feed roller assembly, and a printer housing having an access plate. The separation pad is user-accessible when the access plate is opened.

The present invention also provides a method of replacing a printing apparatus separation pad including removing a bottom plate of the printing apparatus, reaching into the bottom of the printing apparatus, and pulling the separation pad out of said printing apparatus.

Additional advantages and novel features of the invention will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The foregoing and other features and aspects of the invention will become further apparent upon reading the following detailed description and upon reference to the drawings in which.

Figure 1:
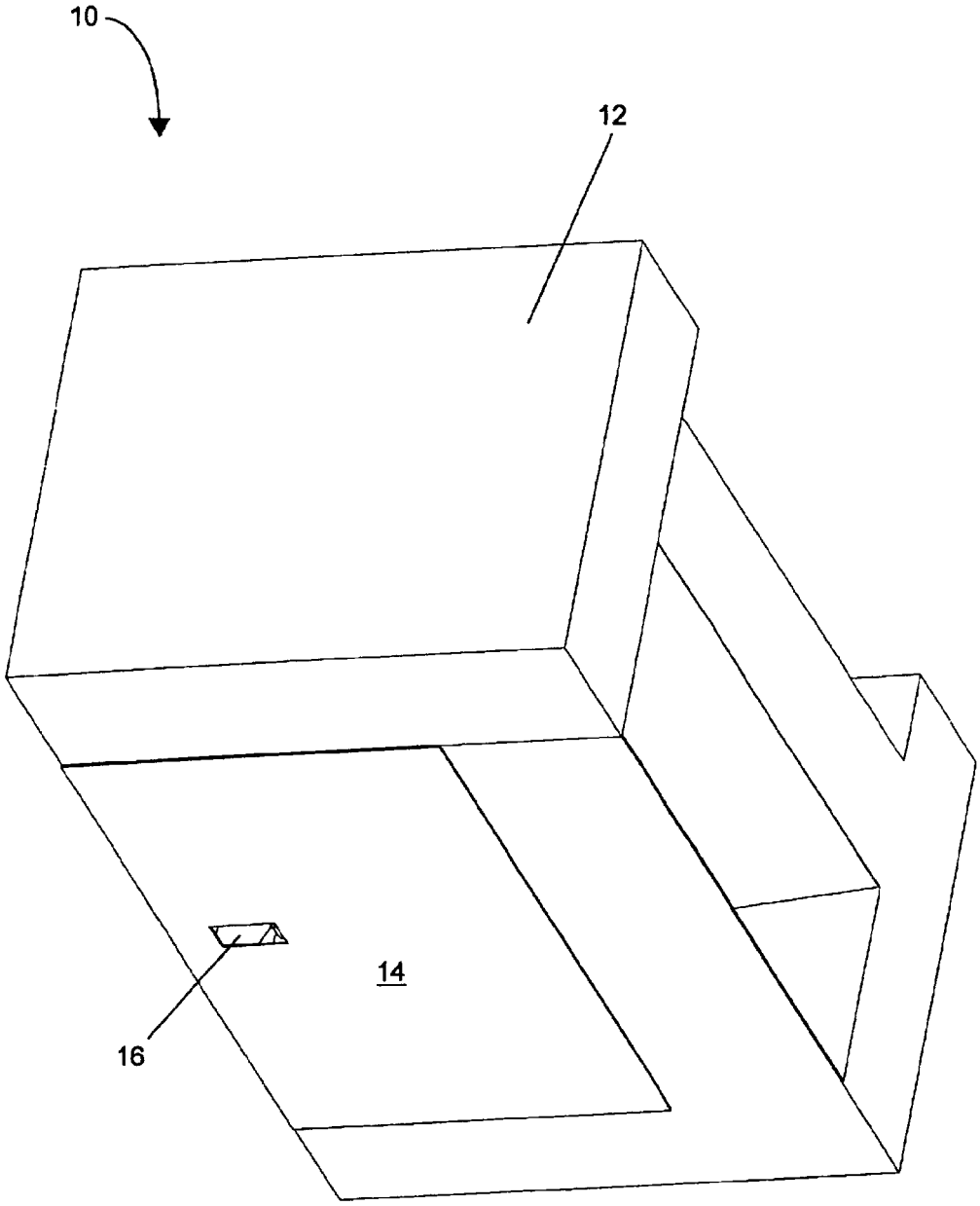
FIG. 1 is a perspective view of a printing device according to one embodiment of the present invention.

In the drawings, identical reference numbers indicate similar, but not necessarily identical, elements. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE EMBODIMENTS

Illustrative embodiments of the invention are described below. As will be appreciated by those skilled in the art, the present invention can be implemented in a wide variety of printing devices.

Turning now to the drawings, and in particular to FIG. 1, a printing device according to one embodiment of the present invention is shown. According to the embodiment of FIG. 1, the printing device is a printer (10). The printer (10) may be an inkjet printer, a laser printer, or other printer. As will be understood by those skilled in the art, the present invention can be implemented in any printing device, including, but not limited to, a printer, a copier, a facsimile machine or any other printing device that uses an automatic feeding mechanism including a separation pad to pull sheets of print media as needed for printing.

The printer (10) includes a printer housing such as plastic housing (12) for enclosing printer components that facilitate document production. Such components may include, but are not limited to, a print engine, memory, rollers, cartridges, trays, power supply devices, and other devices.

The plastic housing (12) of the printer (10) may include a removable bottom plate (14) for facilitating access into the plastic housing (12). The bottom plate (14) is advantageously removable in the embodiment shown without the aid of any tools. The bottom plate (14) may be engaged and disengaged with the plastic housing (12) by the application of force from a user, for example in a snap-fit configuration. The bottom plate (14) may include a biased tab to engage a recess of the plastic housing (12). Alternatively, the bottom plate (14) may be attached to the plastic housing (12) by fasteners such as screws or other fasteners.

The bottom plate (14) may be made of molded plastic or other material and, in the embodiment shown, includes an integrally formed biasing member boss, for example a contoured tab (16). The contoured tab (16) extends toward the interior of the plastic housing (12). The contoured tab (16) is shown in more detail and with further explanation below with reference to FIGS. 2, 3 and 8.

Figure 2:
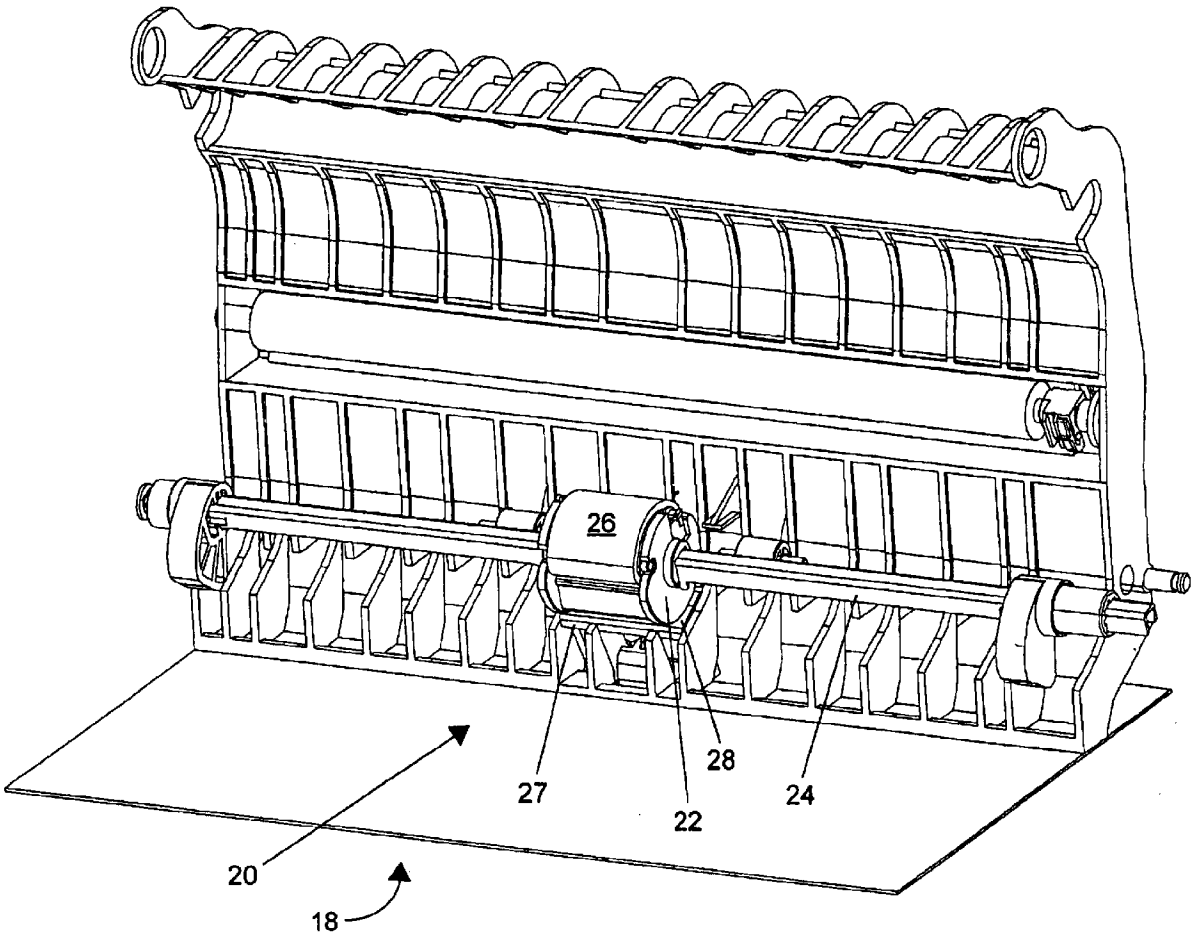
FIG. 2 is a front view of a print media input area in a printing device according to one embodiment of the present invention.

Turning next to FIG. 2, a view of a print media input area (18) of the printer (10, FIG. 1) is shown. The media input area (18) includes a feed roller assembly (20) for grabbing and advancing print media through the printer (10, FIG. 1). A supply of print media is preferably provided adjacent to the input area (18). This supply may be in a tray that is part of the printer (10; FIG. 1). The feed roller assembly (20) may include a main feed roller such as a primary media pick-up roller (22) mounted on a shaft (24). The primary media pick-up roller (22) may include an electrometric surface (26) that facilitates advancement of a print media page by providing a sufficient coefficient of friction between the electrometric surface (26) and a print media (not shown) such that rotation of the primary media pick up roller (22) about the shaft (24) forces a sheet of print media to enter the printer (10, FIG. 1). Sheets of print media are pulled by the pick-up roller (22), preferably from the plane of the input area (18), and moved across the feed path illustrated in FIG. 2 above the pick-up roller (22).

To prevent the introduction of multiple pages simultaneously into a printing device such as the printer (10, FIG. 1), there is a separation pad (27) disposed adjacent to the primary roller (22) according to the embodiment of FIG. 2. The separation pad (27) is biased toward contact with the primary media pick up roller (22) by a biasing member (shown in FIG. 3). The separation pad (27) reduces or eliminates the incidence of multifeeding into the printer (10, FIG. 1) by including a frictional surface (28) arranged adjacent to the primary media pick up roller (22). This frictional surface (28) provides a coefficient of friction with a print media sheet that is greater than the coefficient of friction between adjacent sheets of print media.

According to the embodiment of FIG. 2, the separation pad (27) may be advantageously inserted into the position shown from the bottom of the printer (10, FIG. 1). Prior printer assemblies include separation pads that are attached within the narrow media input area of the printer from the top—as opposed to the present invention that allows the separation pad (27) to be installed from the bottom of the printer (10). Prior printer assemblies that require the separation pad to be installed from above—normally require that the separation pad (27) be installed prior to final printer assembly. The requirement for installation prior to final assembly occurs because sufficient working space for installation of a separation pad in a typical printer (between a primary media pick-up roller and a separation pad mounting area) is only available when the printer is disassembled. Further, when separation pads of typical printers wear out or need repair, typical printers must be at least partially disassembled to repair or replace the separation pads.

Figure 3:
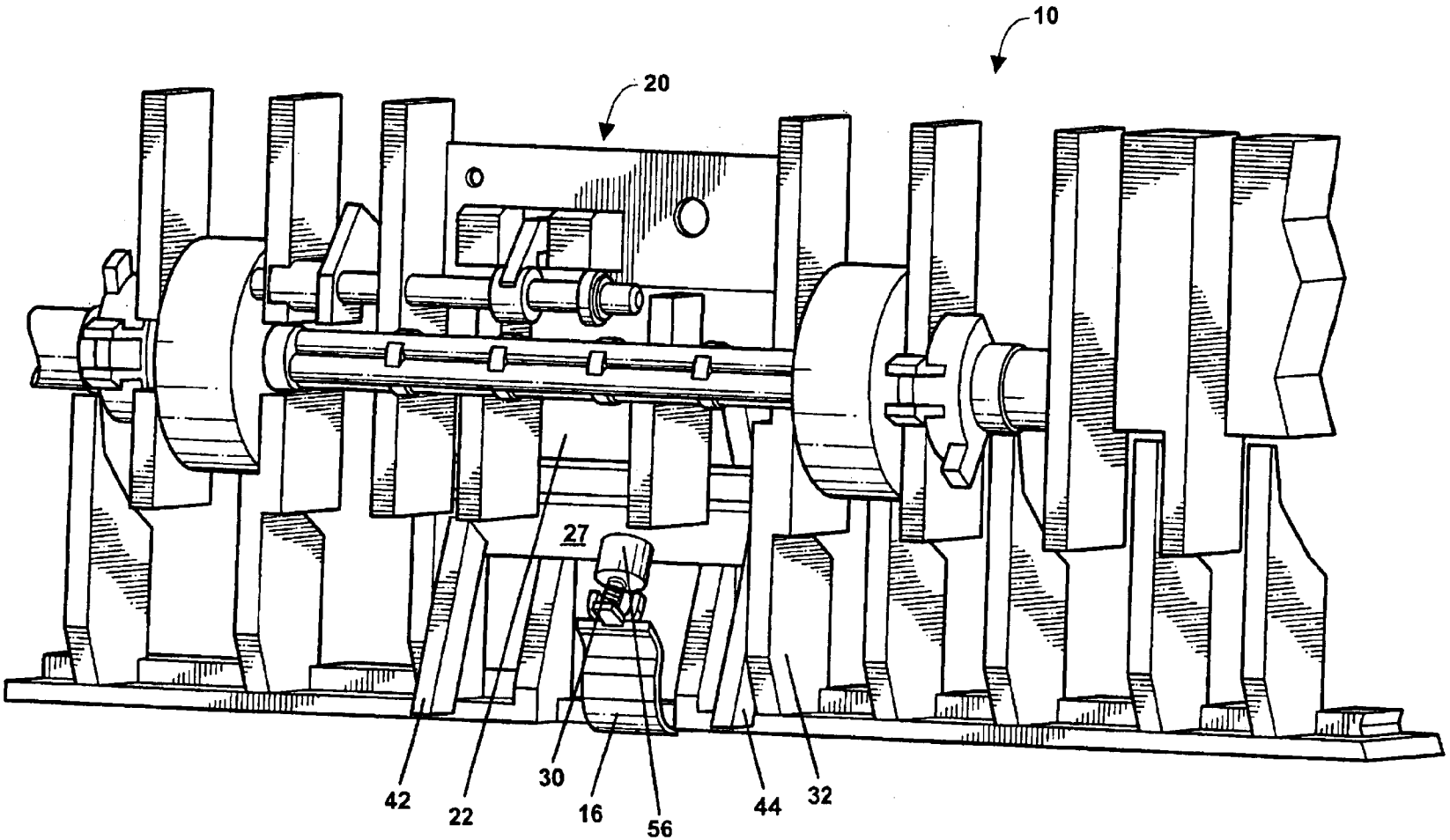
FIG. 3 is a rear view of the print media input area of FIG. 2.

Disassembly of the input area (18) of the printer (10), however, is unnecessary with regard to installation of the separation pad (27) according to principles of the present invention. Turning next to FIG. 3, a rear view of the input area (18) is illustrated and more clearly shows some of the details of the feed roller assembly (20). The feed roller assembly (20) may further include standard printer components, as shown, in addition to the new features described below.

As shown in FIG. 3, the contoured tab (16), which is a biasing member boss, abuts a biasing member, for example a spring (30) arranged in compression between the contoured tab (16) and the separation pad (27). The spring (30) may be attached to the contoured tab (16) in some embodiments, but this is not necessarily so. The spring (30) urges the separation pad (27) toward the primary media pick up roller (22) to prevent the simultaneous feeding of multiple sheets of print media into the printer (10, FIG. 1) as discussed above. The separation pad (27) may be hand-installed from the bottom of the printer (10, FIG. 1) into the position shown in FIG. 3, thereby advantageously eliminating the need for any tools relating to the installation or replacement of the separation pad (27). An operator may remove the bottom plate (14, FIG. 1), reach into the plastic housing (12, FIG. 1), and readily install, remove, or replace the separation pad (27) from the bottom of the printer (10, FIG. 1) without substantial disassembly of the printer itself as has been required in previous printing devices.

As mentioned above, the contoured tab (16) is formed in the bottom plate (14, FIG. 1), therefore, when the bottom plate (14, FIG. 1) is removed from the plastic housing (12, FIG. 1), the biasing force provided by the spring (30) is released. With the removal of the biasing force of the spring (30), the separation pad (27) may slide away from the primary roller (22) and be removed. In some embodiments, the spring (30) is omitted and the contoured tab (16) is formed such that it provides a biasing force by direct contact with the separation pad (27) when the bottom plate (14, FIG. 1) is attached to the plastic housing (12, FIG. 1).

The separation pad (27) is shown in the embodiment of FIG. 3 mounted to a bracket (32) of the printing device (10, FIG. 1) in a sliding configuration. The separation pad (27) may snap into the position shown, after which the separation pad (27) may slide along guide elements within grooves in of the bracket (32). Guide elements and grooves are discussed below with reference to FIGS. 5–7.

Figure 4A:
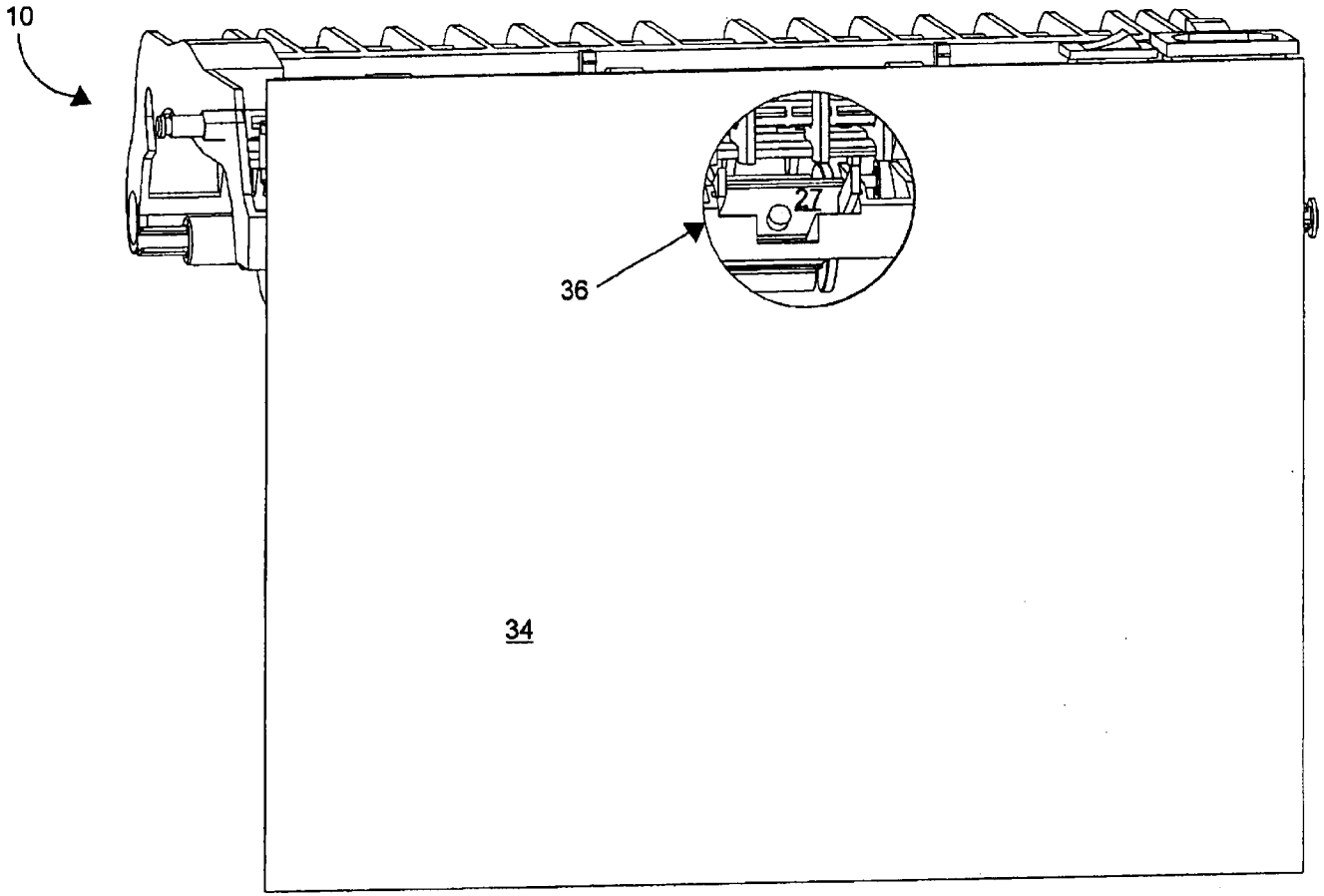
FIG. 4A is a bottom view of a printing device according to one embodiment of the present invention.

Referring next to FIG. 4*a, a* bottom view of the printer (10) with the bottom plate (14, FIG. 1) removed is shown according to one embodiment of the present invention. According to the embodiment of FIG. 4*a*, a printed circuit board (34) of the printing device (10) is shown. Printed circuit boards in printing devices are well known in the art and are available from a variety of sources. However, the printed circuit board (34) according to principles of the present invention may include a separation pad access port (36). In the embodiment shown, the separation pad access port (36) is a circular hole, but this is not necessarily so. The separation pad access port (36) may be any shape, elliptical, circular, polygonal or otherwise that allows access to the separation pad (27). The separation pad access port (36) is arranged in alignment with the separation pad (27) such that a user may access the separation pad (27) through the separation pad access port (36). In some embodiments, the separation pad access port (36) is about two inches in diameter so that a user may insert fingers through the port to remove or install the separation pad (27). In some embodiments the separation pad access port (36) is about two-to-three inches in diameter. And in some embodiments, the separation pad access port (36) is about three-to-four and a half inches in diameter or larger, such that a user may pass a hand or other appendage through the port to remove or install the separation pad (27).

Figure 4B:
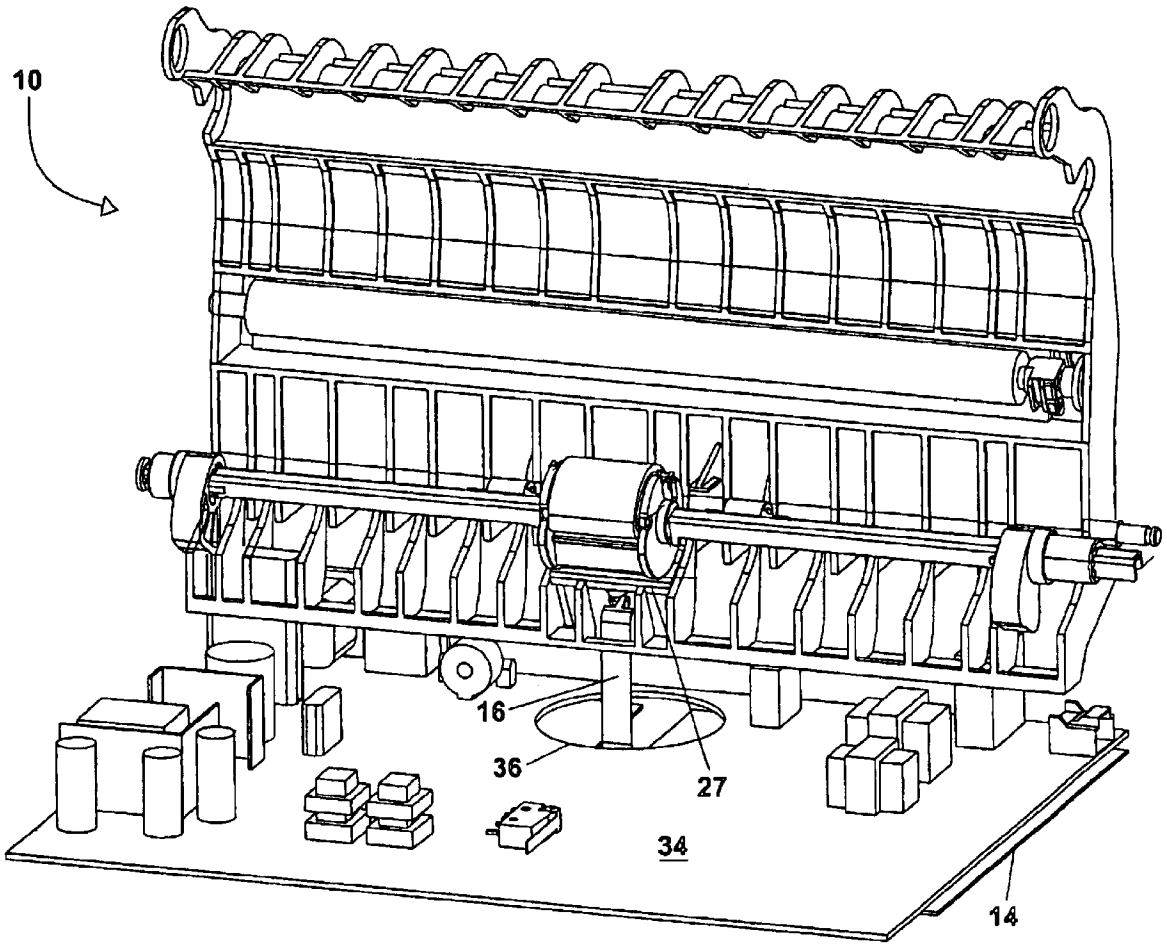
FIG. 4B is a perspective view of the printing device of FIG. 4A.

FIG. 4*b* shows a perspective view of the printing device (10) according to the embodiment shown in FIG. 4*a*. In FIG. 4*b*, the bottom plate (14) is shown in place with the contoured tab (16) engaging the separation pad (27).

Figure 5:
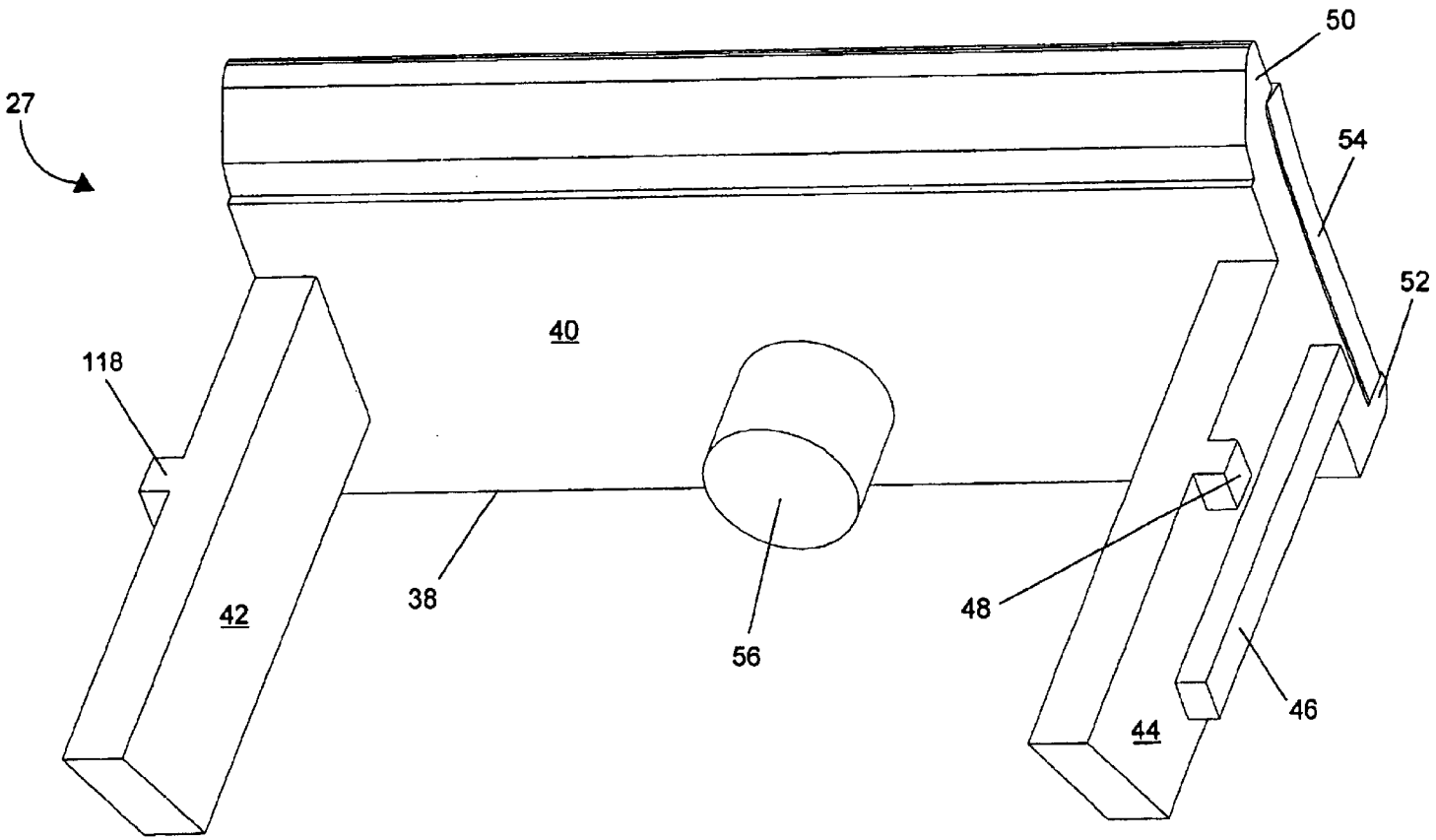
FIG. 5 is a perspective view of a separation pad according to one embodiment of the present invention.

Referring next to FIG. 5, a more detailed view of the separation pad (27) is shown. The separation pad (27) may preferably include a frame (38) made of injection-molded plastic, metal, or other material. According to the embodiment of FIG. 5, the frame (38) includes a cross-member (40) and first and second ears (42 and 44). The first and second ears (42 and 44) may be flexible members enabling the installation and removal of the separation pad (27) from the bracket (32, FIG. 3).

The cross-member (40) of the frame (38) may include a surface (50) located in the present embodiment opposite of the first and second ears (42 and 44). The surface (50) may form a channel (52) receptive of a pad, for example a rubber pad (54). The rubber pad (54) provides the necessary frictional surface for separating print media sheets entering the input area (18, FIG. 2) of a printing device such as the printer (10). The cross-member (40) may be formed around the rubber pad (54), or the rubber pad (54) may be separately inserted into the channel (52) following manufacture of the frame (38).

The frame (38) may also include a separation pad biasing member boss (56). The separation pad biasing member boss (56) may provide a surface for a biasing member such as the spring (30, FIG. 2) to abut against during normal operation of the printer (10, FIG. 1).

Figure 6:
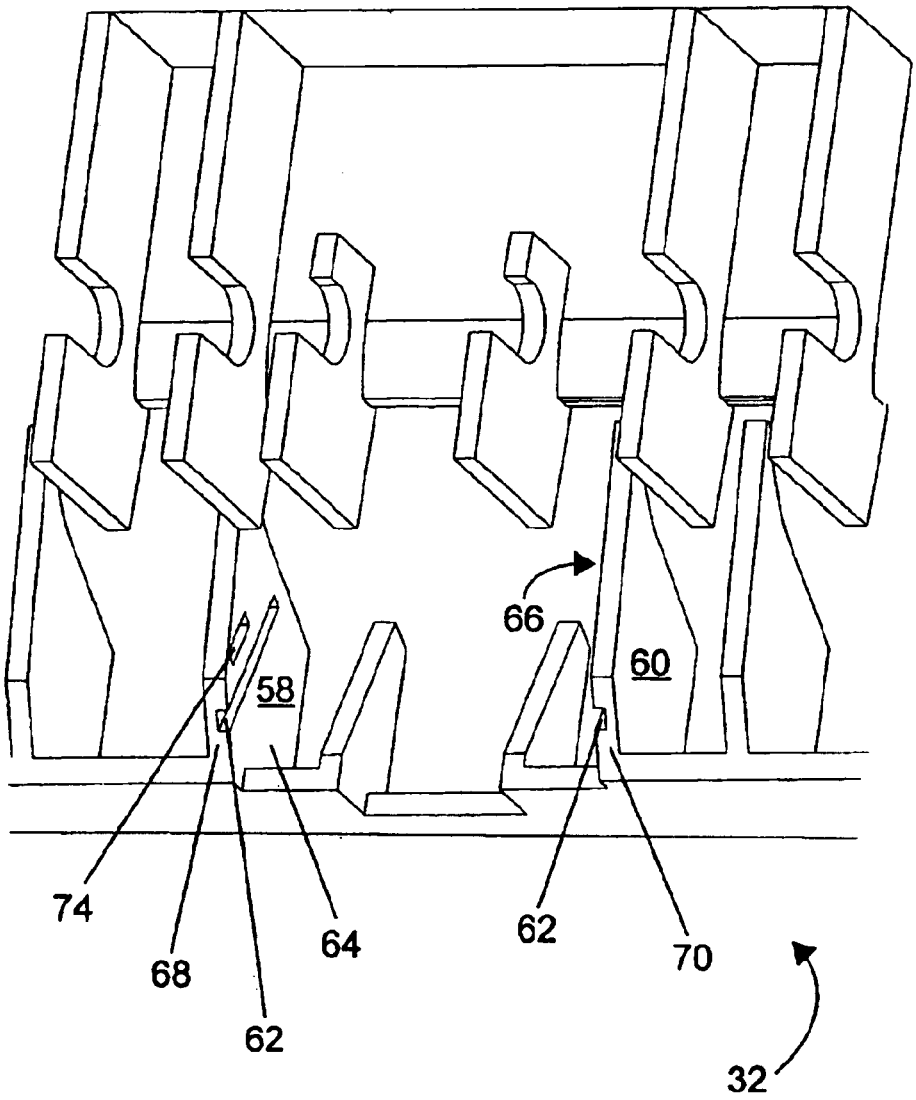
FIG. 6 is a perspective view of a bracket according to one embodiment of the present invention.

Turning next to FIG. 6, the bracket (32) is shown in detail. According to the embodiment of FIG. 6, the bracket (32) includes first and second wings (58 and 60). Each of the first and second wings (58 and 60) may include a first set of grooves (62) receptive of the ribs (46, FIG. 5) of the separation pad (27, FIG. 5). The grooves (62) preferably extend along inner surfaces (64 and 66) of the first and second wings (58 and 60), respectively, all the way to a pair of front surfaces (68 and 70). Therefore, the first set of grooves (62) are open-ended at, at least, the front surfaces (68 and 70). The extension of the first set of grooves (62) to the front surfaces (68 and 70) facilitates the proper installation of the separation pad (27) in the bracket (32) by providing an insertion point and path for the ribs (46, FIG. 5) of the separation pad (27) to follow.

The bracket (32) may also include a second set of grooves (74) receptive of the travel stops (48) located on the separation pad (27). The second set of grooves (74) is closed, meaning that the grooves (74) do not extend to the front surfaces (68 and 70). Consequently, the second set of grooves (74) limit movement of the travel stops (48) of the separation pad (27).

Figure 7:
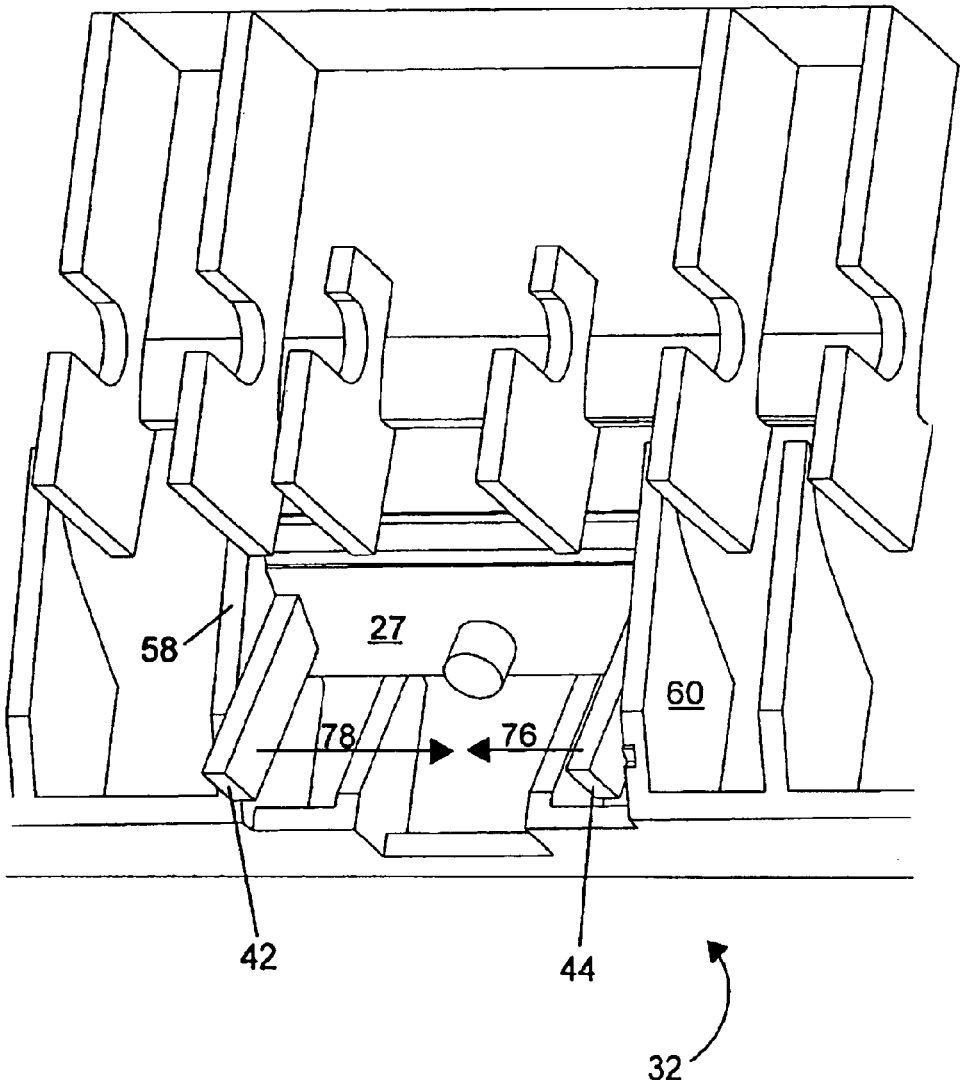
FIG. 7 is a perspective view of the bracket of FIG. 7 with the separation pad of FIG. 5 according to one embodiment of the present invention.

The separation pad (27) may be inserted into or removed from the bracket (32) according the illustration shown in FIG. 7. As shown in FIG. 7, the first and second ears (42 and 44) may be temporarily deformed by the application of force normal to each ear. In the present embodiment illustrated as FIG. 7, by pushing the first and second ears (42 and 44) toward one another as indicated by a pair of arrows (76 and 78), the travel stops (48, FIG. 5) may slide past the first and second wings (58 and 60) until the travel stops (48, FIG. 5) reach and slide into their associated grooves (74). When the travel stops (48, FIG. 5) engage the second set of grooves (74), the first and second ears (42 and 44) may be released and the separation pad (27) is properly installed. Likewise, to remove the separation pad (27) from the bracket (32), the first and second ears (42 and 44) may be pressed together by hand until the travel stops (48, FIG. 5) disengage the second set of grooves (74), enabling the separation pad (27) to be removed from the bracket (32) so that the separation pad (27) may be repaired or replaced.

When the separation pad (27) is mounted in the bracket (32) and the bottom plate (14, FIG. 1) is attached to the plastic housing (12, FIG. 1), the spring (30, FIG. 2) applies a biasing force to the separation pad (27). Therefore, the separation pad (27) is urged toward the primary media pick up roller (22, FIG. 2) along the ribs (46) and the travel stops (48) of the separation pad (27). As the rubber pad (54) wears, the spring (30) continuously urges the separation pad (27) into engagement with the primary media pick up roller (22, FIG. 2). The separation pad (27) may travel the distance defined by the second set of grooves (74) when disposed in the bracket (32). When the rubber pad (54) wears to the point that multiple print medium sheets are being pulled simultaneously by the feeding mechanism, a user may open the bottom plate (14, FIG. 2), reach through the separation pad access port (36, FIG. 4), squeeze the first and second ears (42 and 44) of the separation pad (27), and remove the separation pad (27). Thereafter, the separation pad (27) may be serviced, cleaned, provided with a new rubber pad (54), or replaced altogether. The user may then reattach the bottom plate (14, FIG. 1) and return the printer (10, FIG. 1) to normal printing operations. The entire replacement procedure for the separation pad (27) may be accomplished simply and easily by a consumer without the aid of any tools.

Figure 8:
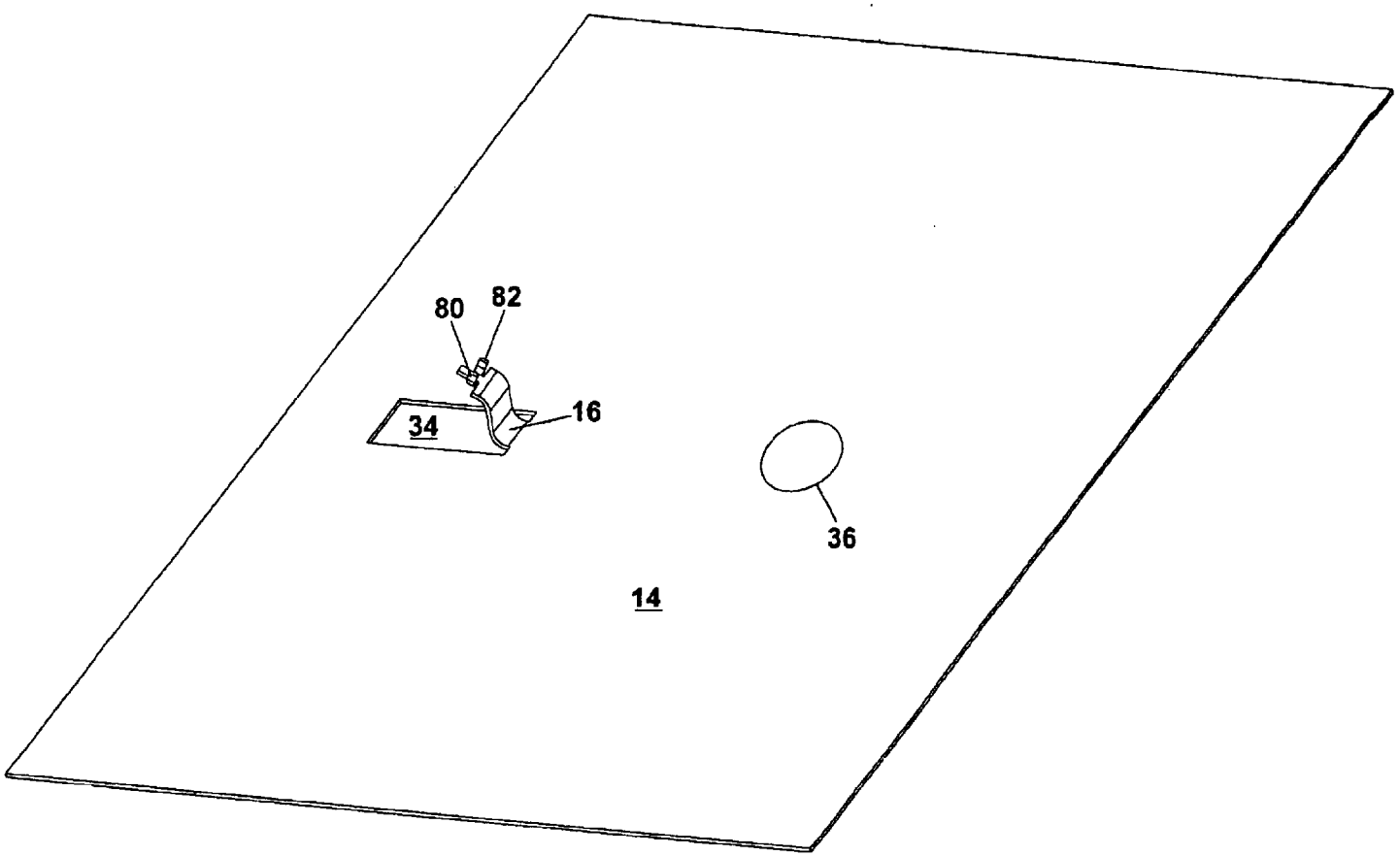
FIG. 8 is a perspective view of a bottom plate of the printing device of FIG. 1 according to one embodiment of the present invention.

Turning next to FIG. 8, a detailed illustration of the bottom plate (14) is shown. According to the embodiment of FIG. 8, the contoured tab (16) is preferably generally S-shaped with a pair of holder arms (80 and 82). The holder arms (80 and 82) may hold a biasing member such as the spring (30, FIG. 3). The contoured tab (16) and associated holder arms (80 and 82) may be stamped to the form shown in the illustrated embodiments where the bottom plate (14) is made of metal. In such embodiments, the stamping may leave a hole (34) proximate to the contoured tab (16). Alternatively, the contoured tab (16) may also be molded with the bottom plate (14) as a single plastic or electrometric piece.

Figure 9:
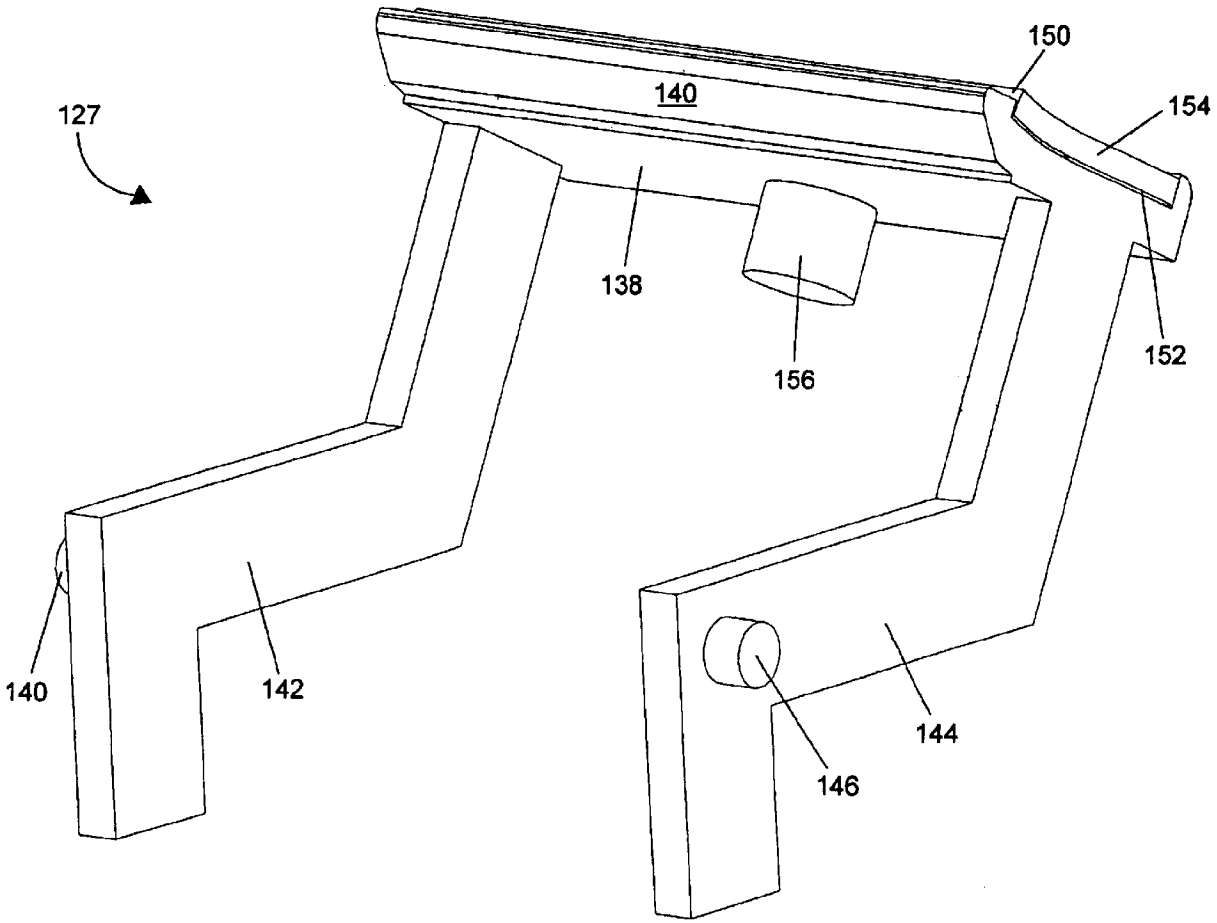
FIG. 9 is a perspective view of a separation pad according to another embodiment of the present invention.

Referring next to FIG. 9, a separation pad (127) according another embodiment of the present invention is shown. The separation pad (127) may include a frame (138) made of injected molded plastic, metal, or other material. According to the embodiment of FIG. 9, the frame (138) includes a cross-member (140) and first and second ears (142 and 144). The first and second ears (142 and 144) may be flexible members enabling the installation and removal of the separation pad (127) from the bracket (132, FIG. 10).

In the embodiment of FIG. 9, the first and second ears (142 and 144) preferably extend substantially normal to the cross-member (140) in a zigzag configuration such that the cross-member (140) may extend laterally from the first and second ears (142 and 144) adjacent to the pick-up roller. Each of the first and second ears (142 and 144) may include a protrusion, which is shown in the figure as a pivot (146). The pivot (146) facilitates rotational installation of the separation pad (127) in the bracket (132, FIG. 10). It will be understood that the first and second ears (142 and 144) may be similar or identical to one another as shown.

The cross-member (140) of the frame (138) may include a surface (150) located in the present embodiment opposite of the first and second ears (142 and 144). The surface (150) may form a channel (152) receptive of a pad, for example a rubber pad (154). The rubber pad (154) provides the necessary frictional surface for separating sheets of print media entering the input area (18, FIG. 2) of a printing device such as the printer (10). The cross-member (140) may be formed around the rubber pad (154), or the rubber pad (154) may be separately inserted into the channel (152) following manufacture of the frame (138).

The frame (138) may also include a separation pad biasing member boss (156). The separation pad biasing member boss (156) may provide a surface for a biasing member such as the spring (30, FIG. 2) to abut during normal operation of the printer (10, FIG. 1).

Figure 10:
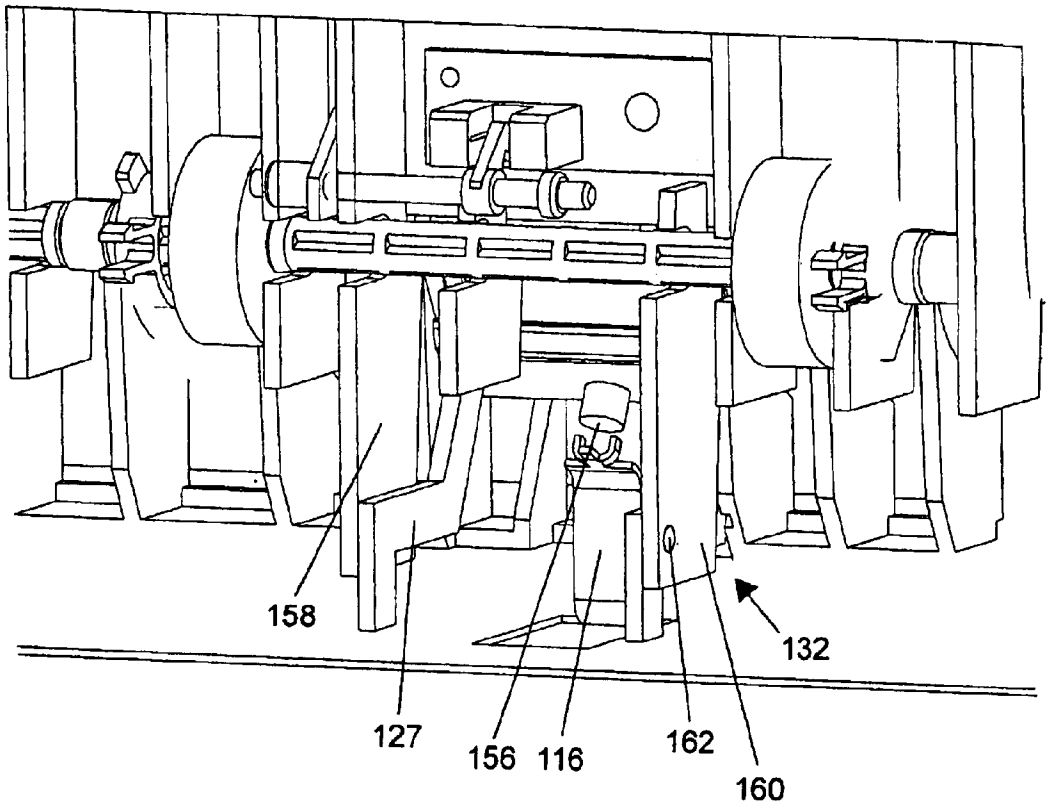
FIG. 10 is a perspective view of a printing apparatus with the separation pad of FIG. 9 installed therein according to an embodiment of the present invention.

Referring next to FIG. 10, the separation pad (127) is shown installed in a bracket (132). According to the embodiment of FIG. 10, the bracket (132) includes first and second wings (158 and 160). Each of the first and second wings (158 and 160) may include a recess or hole (162) receptive of the pivot (146, FIG. 9) of the separation pad (127). The hole (162) allows the separation pad (127) to rotate into and out of engagement with the pick-up roller. A biasing member such as the spring (30, FIG. 2) may be inserted between the biasing member boss (156) and a contoured member (116) to bias the separation pad (127) toward the pick-up roller.

The separation pad (127) may be inserted into or removed from the bracket (132) by squeezing the ears (142 and 144) toward one another. The first and second ears (142 and 144) may be temporarily deformed by the application of force normal to each ear (142 and 144). In the present embodiment, by squeezing the first and second ears (142 and 144) toward one another, the pivots (146) may be positioned adjacent to the holes (162). As the first and second ears (142 and 144) are released, the pivots (146) engage the holes (162) in a rotational connection. The separation pad (127) may then rotate into the position shown in FIG. 10 and the separation pad (127) is properly installed. Likewise, to remove the separation pad (127) from the bracket (132), the first and second ears (142 and 144) may be pressed together by hand until the pivots (146) disengage the holes (162), enabling the separation pad (127) to be removed from the bracket (32) so that the separation pad (127) may be repaired or replaced.

The preceding description has been presented only to illustrate and describe the invention. It is not intended to be exhaustive or to limit the invention to any precise form disclosed. Many modifications and variations are possible in light of the above teaching.

The embodiments were chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A printing device comprising:

a feed roller assembly;

a separation pad located adjacent to said feed roller assembly;

a printer housing having a removable bottom plate, wherein said separation pad is not attached to said removable bottom plate, but is user-accessible when said bottom plate is removed from said printer housing; and a circuit board disposed between said separation pad and said removable bottom plate, said circuit board having a separation pad access hole therein.

2. The printing device of claim 1, wherein said separation pad access hole comprises an elliptical, circular, or polygonal shape having an opening of about three inches across or more.

3. A printing device comprising:

a feed roller assembly;

a separation pad located adjacent to said feed roller assembly;

a printer housing having a removable bottom plate, wherein said separation pad is user-accessible when said bottom plate is removed from said printer housing; and wherein said removable bottom plate comprises a biasing member boss with a biasing member disposed between said biasing member boss and said separation pad for urging said separation pad into engagement with a main feed roller of said feed roller assembly.

4. The printing device of claim 3, wherein removing said bottom plate from said printer housing releases force provided by said biasing member on said separation pad.

5. A printing device comprising:

a feed roller assembly;

a separation pad located adjacent to said feed roller assembly;

a printer housing having a removable bottom plate, wherein said separation pad is user-accessible when said bottom late is removed from said printer housing;

wherein said separation pad comprises a frame having first and second ears; and wherein said separation pad further comprises pivots on each of said first and second ears.

6. The printing device of claim 5, wherein said pivots on each of said first and second ears rotationally engage a set of recesses of a separation pad bracket, and wherein said pivots disengage said set of recesses in response to the application of pressure substantially normal to said first and second ears.

7. A printing device comprising:

a separation pad mounted in a frame that is removably disposed in a racket inside of said printing device, wherein said bracket is oriented such that said separation pad frame is mounted in said bracket from a bottom of said printing device;

a printer housing having a removable bottom plate;

wherein said separation pad frame is user-accessible when said bottom plate is removed from said printer housing;

further comprising a separation pad access port in a circuit board of said printing device, said circuit board being dispose between said separation pad and said bottom plate.

8. The printing device of claim 7, wherein said separation pad frame comprises a cross-member and two flexible ears extending from said cross-member, wherein said frame is engageable with said printing device in a snap-fit or pivoting-fit by flexing and releasing said two flexible ears.

9. A method of replacing a printing device separation pad comprising:

removing a bottom plate of said printing device, reaching into the bottom of said printing device, and pulling said separation pad out of said printing device, wherein reaching into the bottom of said printing device further comprises reaching through a separation pad access port in a circuit board of said printing device.

10. A method of replacing a printing device separation pad comprising:

removing a bottom plate of said printing device, reaching into the bottom of said printing device, and pulling said separation pad out of said printing device, wherein said removing of said bottom plate comprises releasing pressure from a biasing member on said separation pad.

11. A printing device comprising:

a printer housing having a removable bottom plate;

a separation pad disposed in said printer housing; and a circuit board having a hole therein aligned with said separation pad and providing access to said separation pad.

12. The printing device of claim 11, wherein said hole is elliptical, circular, or polygonal with an opening of at least about two inches.

13. A printing device comprising:

means for separating media sheets in said printing device;

removable means for covering a bottom portion of said printing device; and access means for hand-reaching said means for separating media sheets inside said printing device when said removable means for covering said bottom portion are removed;

wherein said access means further comprises a hole in a circuit board of said printing device.

14. A printing device comprising:

a feed roller assembly;

a separation pad located adjacent to said feed roller assembly;

a printer housing having an access plate, wherein said separate pad is not attached to said access plate, wherein said separation pad is user-accessible when said late is opened; and a circuit board disposed between said separation pad and said access plate, said circuit board having a separation pad access hole therein.

15. A printing device comprising:

a print media input area;

a feed roller assembly;

a separation pad located adjacent to said feed roller assembly;

a printer housing having a removable access plate, wherein said removable access plate is separate from said print media input area and does not support or contain print media, wherein said separation pad is user-accessible when said access plate is removed from said printer housing; and a circuit board disposed between said separation pad and said access plate, said circuit board having a separation pad access hole therein.

16. A printing device comprising:

a printer housing having an underside;

a feed roller assembly;

a separation pad located adjacent to said feed roller assembly;

a removable bottom access panel in said underside of said printer housing; and a circuit board disposed between said separation pad and said removable bottom access panel said circuit board having a separation pad access hole therein.

* * * * *

UNITED STATES PATENT AND TRADEMARK OFFICE

CERTIFICATE OF CORRECTION

PATENT NO. : 6,932,529 B2
APPLICATION NO. : 10/218276
DATED : August 23, 2005
INVENTOR(S) : Dean Richtsmeier et al.

It is certified that error appears in the above-identified patent and that said Letters Patent is hereby corrected as shown below:

IN THE CLAIMS

Column 10, Claim 14, line 20, delete "late" and insert therefor --plate--

Signed and Sealed this

Thirtieth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 6,932,529 B2
APPLICATION NO. : 10/218276
DATED : August 23, 2005
INVENTOR(S) : Dean Richtsmeier et al.

It is certified that error appears in the above-identified patent and that said Letters Patent is hereby corrected as shown below:

IN THE SPECIFICATION

Column 1, line 35, delete “feed” and insert therefor --fed--

IN THE CLAIMS

Claim 14, Column 10, line 20, delete “late” and insert therefor --plate--

Signed and Sealed this

Twentieth Day of May, 2008

JON W. DUDAS
*Director of the United States Patent and Trademark Office*